United States Patent [19]

Speegle

[11] Patent Number: 4,550,634

[45] Date of Patent: Nov. 5, 1985

[54] SEAM PULLING TOOL FOR TEARING OUT WELDED SEAMS OF CONTAINERS

[76] Inventor: Robert W. Speegle, 50 N. Corona Dr., Porterville, Calif. 93257

[21] Appl. No.: 595,902

[22] Filed: Apr. 2, 1984

[51] Int. Cl.[4] ..... B25B 7/02; B25B 7/22

[52] U.S. Cl. ..... 81/418; 7/134; 30/134

[58] Field of Search ..... 81/418–426; 7/132–134; 30/134, 135, 145, 124; 228/264; 72/409–410

[56] References Cited

U.S. PATENT DOCUMENTS

| | | | |
|---|---|---|---|
| 201,006 | 3/1878 | Hale | 30/134 |
| 1,800,447 | 4/1931 | Froeschl | 81/426 X |
| 1,887,732 | 11/1932 | Pagel et al. | 72/409 X |
| 2,853,908 | 9/1958 | Logan | 72/409 X |
| 3,058,213 | 10/1962 | Sandsto | 7/134 X |

*Primary Examiner*—Frederick R. Schmidt
*Assistant Examiner*—Debra S. Meislin
*Attorney, Agent, or Firm*—Owen, Wickersham & Erickson

[57] ABSTRACT

A seam pulling tool for use in quality control of can manufacture. A pair of pliers have novel upper and lower jaws. The lower jaw has a trapezoidal central flat portion, wider at the rear than at the front, and a vertical side portions on each side of the flat portion with a sharp cutting edge at the top sloping upwardly and rearwardly relatively to the flat portion. The upper jaw has a flat surface the same size as the central flat portion and perpendicular sides providing a sharp cutting edge at each side.

3 Claims, 9 Drawing Figures

FIG. 1
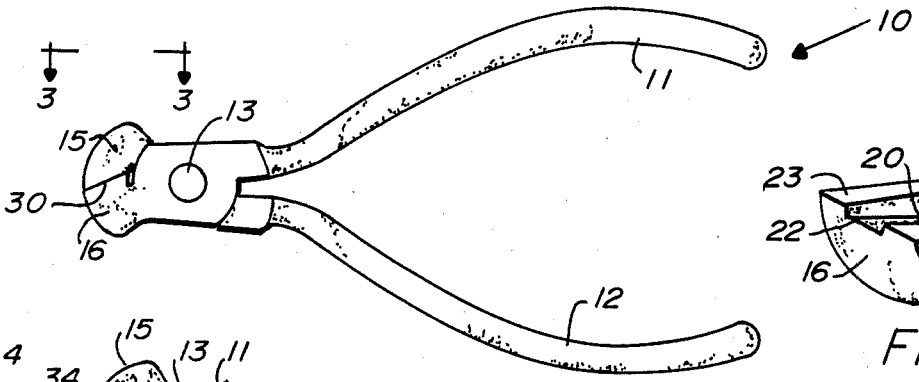
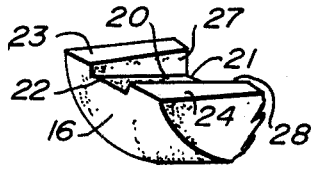
FIG. 7
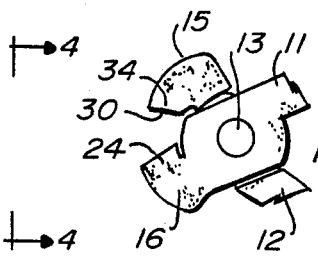
FIG. 2
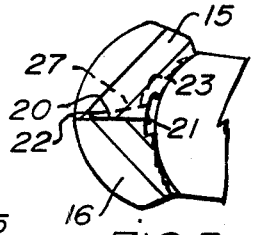
FIG. 5
FIG. 3
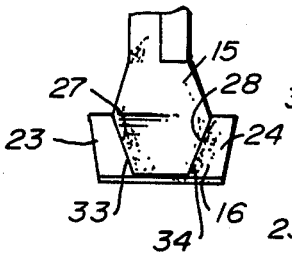
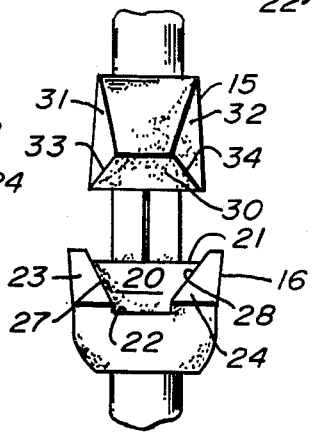
FIG. 4
FIG. 6
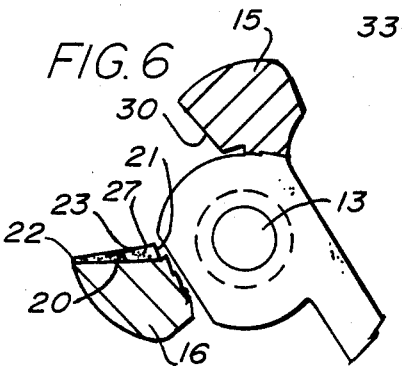
FIG. 9
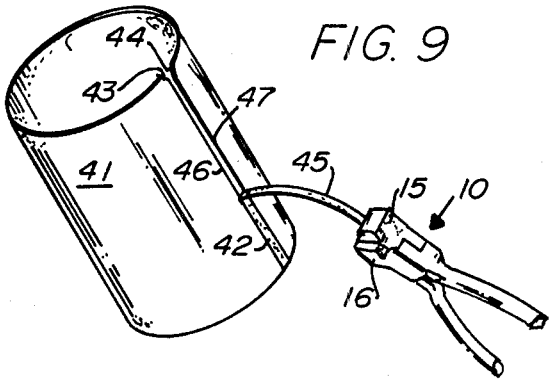
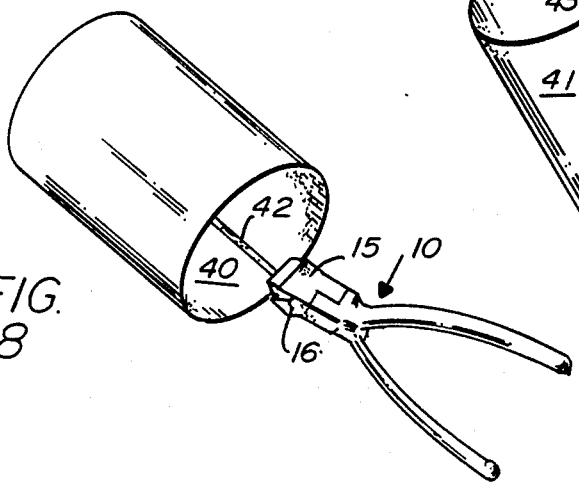
FIG. 8

SEAM PULLING TOOL FOR TEARING OUT WELDED SEAMS OF CONTAINERS

This invention relates to a hand tool for tearing out welded seams of metal containers.

BACKGROUND OF THE INVENTION

With the U.S. Government requiring that the use of soldered side seams in the production of food containers be gradually eliminated and initiating the use of two-piece constructed cans or welded three piece constructed cans, a "Tear Test" procedure is now required by U.S. Government Standards for testing and controlling the quality of the side seams of such cans.

The U.S. Government requires, as quality control in the manufacturing of welded side seams, that random tests be made on the side seams of cans. The government standards require a side seam test to check for weld cracks and other faults in seam construction. While visual inspection of the cans is constantly required, a more thorough inspection makes it necessary to pull the welded seam from random sampled cans. Government standards require that this test be made at least six times in each production hour or forty-eight times in each eight-hour production shift. This test is, then, performed many times each day by thousands of inspectors, mechanics and other workers in thousands of can manufacturing plants in the United States and also elsewhere in the world.

At present, an inspector uses at least two tools, and often three, in each performance of this test. One tool is used to make two initial cuts near a side seam, one on each side of the seam. The can is then placed over a mandrel and another tool is used to pull the seam from the can. This procedure substantially confines the inspector to a work bench during the test.

The "welded can" is relatively new, and theretofore the need to improve on the quality of the can apparently has overshadowed the need to improve the methods of inspecting the product. At any rate, no advancements have been made in the tools used in this particular pulling test.

An object of the present invention is to provide a single tool that can be used to conduct the entire required test, giving at least as high quality and as useful results as the heretofore-used three tools.

Another object is to provide a single tool that cuts and pulls the seam, all in one simple operation and gives results at least equal to those obtained heretofore.

Another object is to relieve the inspector from substantial confinement to a work bench, giving him more mobility by enabling the tests to be made at various locations along the production line.

Another object of the invention is to save time and effort and to enable the test to be made at more stages of manufacturing.

Another object is to enable not only inspectors, but also mechanics and others involved in can manufacturing to make better, more effective, instant, on-the-spot checks of the side seams of a welded can.

Another object is to provide a practical, more inexpensive way to improve the testing methods now used and accepted throughout the world.

Although this tool which will be used primarily in tear-testing in three-piece-constructed welded can manufacturing side seam testing and quality control, it may also be employed in or adapted to other uses.

SUMMARY OF THE INVENTION

The tool resembles a pair of pliers to cut into the edge of the can and to grip the seam, all in one simple action. The pliers have an upper jaw and a lower jaw.

The lower jaw has a central flat portion that is trapezoidal in shape, being wider at the rear than at the the front. Two symmetrical side portions, one on each side of the flat portion, slope relatively thereto, being slightly raised thereabove at the front and more so at the rear. The structure is made to provide a sharp cutting edge at each side of the central flat portion.

The upper jaw has a flat surface the same size as the central flat portion and mates with its sharp side edges when the jaws are fully closed.

The open jaws can be applied at one end of a can seam and closed to cut two diagonal notches, one in on each side of and toward the seam. Then, when the jaws are fully closed, the pliers can be pulled down the seam to sever the seam portion from the can.

BRIEF DESCRIPTION OF THE DRAWINGS

FIG. 1 is a view in side elevation of a hand tool embodying the principles of the invention with the jaws in closed position.

FIG. 2 is a fragmentary view of the jaws portion of FIG. 1 in side elevation showing the jaws opened.

FIG. 3 is a fragmentary top plan view taken along the line 3—3 of FIG. 1.

FIG. 4 is an enlarged fragmentary view in end elevation as viewed along the line 4—4 in FIG. 2.

FIG. 5 is a view in section taken along the line 5—5 in FIG. 3, with the jaws shown in their closed position, a broken line indicating a portion of the lower jaw that lies behind the upper jaw.

FIG. 6 is a view in section similar to FIG. 5 but with the jaws open.

FIG. 7 is a fragmentary view in perspective of the lower jaw.

FIG. 8 is an isometric view of a can having a welded seam with the tool of the invention being impressed thereinto to make the initial cut.

FIG. 9 is a somewhat similar view, but with some parts rotated, showing that the initial cut has been made and that the seam is being pulled.

DESCRIPTION OF A PREFERRED EMBODIMENT

FIG. 1 shows a tool 10 embodying the principles of the invention. There are two curved arms 11 and 12 which are secured together by a pivot pin 13. The tool 10 has two jaws, which will be described herein as an upper jaw 15 and a lower jaw 16 by virtue of the position shown in the drawings, although they may, of course, be inverted or in any other position. The arms 11 and 12 are used to open an close the jaws 15 and 16.

The lower jaw 16 has a central flat portion 20 which is generally trapezoidal in shape, as can best be seen in FIGS. 4 and 7. It is wider at the rear edge 21 than at its front edge 22. Two symmetrical side portions 23 and 24, one on each side of the flat portion 20, slope relatively to it, diverging from it when moving from front to rear, so that the side portions 23 and 24 are slightly raised above the central flat portion 20 at the front end 22, and are raised even higher above it at the rear end 21. This can be seen best in FIGS. 5 and 6. The side portions 23, 24 are each joined to the central portion 20 by a perpendicular surface 27, 28 which provides a sharp cutting edge at each side of the central flat portion 20, especially at the upper edges of the surfaces 27, 28 along the upper end of the side portions 23 and 24.

The upper jaw 15 has a flat lower surface 30, which is the same size as the central flat portion 20, and has side walls 31 and 32 perpendicular to the surface 30 and edges 33 and 34 providing a sharp cutting edge on each side. This flat surface 30 mates with the central flat portion 20 when the jaws 15 and 16 are fully closed.

As shown in FIG. 8, the jaws 15 and 16 can be closed against the opposite surfaces 40 and 41 of a can at one end of a container seam 42 and closed; they then cut diagonally in along the sharp edges 27, 33 and 28, 34 on each side of the seam 42, with diagonal cuts 43 and 44 extending in toward the seam 42. This can be seen in FIG. 9 where the cuts 43 and 44 have has been made. Once the jaws 15 and 16 are closed and the cut made, the tool 10 can be pulled down along the seam 42 to sever a seam portion 45 from the can, as shown in FIG. 9. The portion 45 pulled off can be inspected, as may the edges 46 and 47 left on the can, if that is desirable.

Thus, the sharp edge portions 27, 28 and 33, 34 provide the initial cut, and then the tight grip of the central portion 20 of the lower jaw 16 and the surface 30 of the upper jaw 15 clamp firmly, to enable tearing the strip 45 from the can along the seam 42. It is clear from this that the single tool 10 aided only by the hand which holds the can during the operation, is all that is needed in place of having separate cutters for making the initial cuts and mandrels for aiding in the seam pulling.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A seam pulling tool for use, with a selected can having a metal wall with a rectilinear welded side seam, in quality control of can manufacture, including in combination:

a pair of pliers with an upper jaw and a lower jaw, said lower jaw having a trapezoidal central flat portion having a front and a rear edge and two sides and being wider at the rear edge between said sides than at the front edge, and a vertical side portion extending up from each side of said flat portion, each said side portion having a sharp cutting upper edge, inclined upwardly toward said rear edge, said upper jaw having a flat surface the same shape and nearly the same size as said central flat portion and having side walls perpendicular to said flat portion, said side walls providing a sharp cutting bottom edge at each side of said flat surface, the difference in size between said flat portion and said flat surface being only enough to enable engagement of said flat portion and said flat surface against each other when said upper and lower jaws are closed against each other, so that when said jaws are closed said side walls pass closely adjacent to their respective side portions and each said sharp cutting bottom edge moves by said sharp cutting upper edge to provide shearing action that can cut the wall of said selected can on each side of the selected can's side seam at an angle that is wide at the top and narrow toward said seam due to the divergence from front to rear of the cutting edges, then, when said jaws are closed on opposite sides of the can wall, said tool grasps a strip portion between cut lines of said can wall and said tool can then be pulled down along said seam for as far as desired.

2. A seam pulling tool for tearing welded seams for metal containers, including in combination:

a pair of pliers with an upper jaw and a lower jaw, said lower jaw having a central flat portion that is trapezoidal in shape, with a rear edge, a front edge, and two side edges, being wider at said rear edge than at said front edge, and two symmetrical diverging side portions, one on each said side edge of said flat portion and sloping relatively thereto by being slightly raised thereabove at the front edge and raised higher thereabove at the rear edge, each said side portion being joined to said central flat portion by a surface perpendicular to said central flat portion, said surface meeting the side portion at a sharp cutting upper edge at each side of said central flat portion, said upper jaw having a flat surface the same shape and nearly the same size as said central flat portion and having side walls perpendicular to said flat surface and meeting said flat surface at a sharp cutting bottom edge at each side thereof, said flat surface mating with and engaging said central flat portion when the jaws are fully closed, with just enough difference in size to enable said mating and engaging, whereby said jaws can be applied at one end of a container seam and closed to cut the container along two lines by the shearing action of the opposed upper and lower cutting edges, said cut lines leading diagonally inwardly toward each other on each side of and toward said seam, the lines being diagonal due to the trapezoidal shapes of said flat portion and said flat surface and the resulting angular relation of the two pairs of cutting edges to each other, then, when said jaws are closed and tightly grasp said container seam, said tool can be pulled down the seam to sever a seam portion from said can.

3. A method of pulling a seam from the wall of a metal container in order to enable inspection thereof, with the aid of a tool comprising a pair of pliers with an upper jaw and a lower jaw, said lower jaw having a trapezoidal central flat portion bounded by a front edge, a rear edge, and two side edges, said flat portion being wider at the rear edge than at the front edge, and a side wall along each said side edge of said flat portion and perpendicular thereto and leading upwardly and providing a sharp cutting upper edge at each side of said central flat portion, said upper jaw having a flat surface the same shape and substantially the same size as said central flat portion, with only enough size differential to enable full closure of said jaws, and having side edges meeting perpendicular walls leading upwardly therefrom and providing a sharp cutting edge at each side where the flat portion of the upper jaw meets the side walls thereof, said flat surface mating with said central flat portion when the jaws are fully closed, said method comprising the steps of closing said jaws on opposite sides of a said metal container at one edge, centered on a seam, by shearing the container wall by the movement of said cutting edges toward and beyond each other to cut diagonally inwardly on each side of and toward said seam, along the edges of the trapezoidal portion of said jaws as said cutting edges cooperate to shear the container wall, gripping the seam with the central flat portion and the flat surface, and, with the jaws still closed, pulling the tool down the seam to strip from the can a seam portion.

* * * * *